US012084941B2

(12) United States Patent
Sætre et al.

(10) Patent No.: US 12,084,941 B2
(45) Date of Patent: Sep. 10, 2024

(54) DEVICE COMPRISING A DISSOLVABLE MATERIAL FOR USE IN A WELLBORE

(71) Applicant: Marwell AS, Stavanger (NO)

(72) Inventors: Geirmund Sætre, Hafrsfjord (NO); Michael K. Williamson, Stavanger (NO)

(73) Assignee: Marwell AS, Stavanger (NO)

( * ) Notice: Subject to any disclaimer, the term of this patent is extended or adjusted under 35 U.S.C. 154(b) by 106 days.

(21) Appl. No.: 17/775,483

(22) PCT Filed: Nov. 4, 2020

(86) PCT No.: PCT/NO2020/050269
§ 371 (c)(1),
(2) Date: May 9, 2022

(87) PCT Pub. No.: WO2021/096364
PCT Pub. Date: May 20, 2021

(65) Prior Publication Data

US 2022/0372834 A1 Nov. 24, 2022

(30) Foreign Application Priority Data

Nov. 15, 2019 (NO) ..... 20191355

(51) Int. Cl.
*E21B 33/12* (2006.01)

(52) U.S. Cl.
CPC ..... *E21B 33/1208* (2013.01); *E21B 2200/08* (2020.05)

(58) Field of Classification Search
CPC .. E21B 33/1208; E21B 33/134; E21B 34/063; E21B 34/085; E21B 43/12; E21B 2200/08
See application file for complete search history.

(56) References Cited

U.S. PATENT DOCUMENTS

2008/0135249 A1* 6/2008 Fripp ..... E21B 43/088 166/65.1
2013/0206425 A1* 8/2013 Mazyar ..... E21B 34/063 166/376
2014/0190705 A1* 7/2014 Fripp ..... E21B 34/063 166/376
2014/0284063 A1* 9/2014 Fripp ..... E21B 29/00 166/376

(Continued)

FOREIGN PATENT DOCUMENTS

WO 2016/058948 4/2016
WO 2017086955 5/2017

OTHER PUBLICATIONS

Norwegian Search Report for No. 20191355, dated May 18, 2020.

(Continued)

*Primary Examiner* — Tara Schimpf
*Assistant Examiner* — Jennifer A Railey
(74) *Attorney, Agent, or Firm* — Andrus Intellectual Property Law, LLP

(57) ABSTRACT

A device is for use in a wellbore. The device has a dissolvable material for being dissolved over a limited time period and an electrically insulating material covering a portion of the dissolvable material for keeping the dissolvable material out of contact with any more noble material when the device is in use. A tubing has the device for use of the device.

14 Claims, 1 Drawing Sheet

(56) References Cited

U.S. PATENT DOCUMENTS

| | | | | |
|---|---|---|---|---|
| 2015/0299558 | A1 | 10/2015 | Sui et al. | |
| 2018/0171743 | A1 | 6/2018 | Markel et al. | |
| 2018/0328139 | A1 | 11/2018 | Mhaskar | |
| 2020/0332619 | A1* | 10/2020 | Elliott | E21B 33/134 |

OTHER PUBLICATIONS

International Search Report and the Written Opinion for PCT/NO2020/050269, dated Jan. 18, 2021.
Second Written Opinion for PCT/NO2020/050269, dated Dec. 15, 2021.
International Preliminary Report on Patentability for PCT/NO2020/050269, dated Feb. 1, 2022.
Extended European Search Report for EP Application No. 20888198.7, dated Oct. 30, 2023.

* cited by examiner

DEVICE COMPRISING A DISSOLVABLE MATERIAL FOR USE IN A WELLBORE

CROSS-REFERENCE TO RELATED APPLICATIONS

This application is the U.S. national stage application of International Application PCT/NO2020/050269, filed Nov. 4, 2020, which international application was published on May 20, 2021, as International Publication WO 2021/096364 in the English language. The International Application claims priority of Norwegian Patent Application No. 20191355, filed Nov. 15, 2019. The international application and Norwegian application are both incorporated herein by reference, in entirety.

FIELD

The invention relates to a device for use in a wellbore, the device comprising a dissolvable material for being dissolved over a limited time period, to a tubing comprising the device, and to use of the device.

BACKGROUND

In the oil and gas industry, situations arise where it is necessary or beneficial to block the flow of fluid in a tubing for a limited time. This is typically done by installing a plug in the tubing, where the plug comprises a material which will dissolve over time. In this way, the desired effect is achieved for a limited time. Dissolving material has been used in oil and gas wells for several years to create temporary barriers or activate downhole tools. The process takes place when a dissolvable material, typically a special alloy of magnesium, is in contact with chloride-containing water. However, the dissolvable material at times dissolves too quickly, at least partly because the plug is usually very small, whereby the time period of the effect is too short.

SUMMARY

The invention has for its object to remedy or to reduce at least one of the drawbacks of the prior art, or at least provide a useful alternative to prior art. The object is achieved through features which are specified in the description below and in the claims that follow. The invention is defined by the independent patent claims, and the dependent claims define advantageous embodiments of the invention.

In a first aspect the invention relates more particularly to a device for use in a wellbore, the device comprising a dissolvable material for being dissolved over a limited time period, wherein the device further comprises an electrically insulating material covering a portion of the dissolvable material for keeping the dissolvable material out of contact with any more noble material when the device is in use. The dissolvable material and the more noble material may typically both be metals, and the dissolution of the dissolvable material may for example occur by corrosion such as oxidation. When in use, the device is typically in contact with a fluid, for example saltwater or a wellbore fluid, which may act as an electrolyte.

The invention is based on the observation that the dissolvable materials used in prior art are generally susceptible to galvanic corrosion and are positioned at locations in the wellbore where they are in electrical connection with a more noble material. This will allow electrons to be transferred from the dissolvable material to the more noble material via the electrical connection, which will cause galvanic corrosion of the material which is less noble, i.e. the one which has the lowest electrode potential. This may significantly increase the rate of dissolution of the dissolvable material when it is susceptible to galvanic corrosion, as it typically has a low electrode potential.

To prevent the transfer of electrons, and thereby prevent or decrease the risk of galvanic corrosion, the device includes an electrically insulating material, which prevents or at least decreases electrical connection between the dissolvable material and any more noble material. This has been observed to considerably decrease the rate of dissolution of the dissolvable materials which are typically used, since the rapid dissolution of the dissolvable material by galvanic corrosion is avoided. The dissolvable material may thereby function for a much longer time, sometimes more than five times than if the electrically insulating material were not included. This effect is larger the smaller the dissolvable material part is. An important effect of the device is therefore to provide device comprising a dissolvable material, wherein the dissolution process is better controlled regardless of the dissolvable material used. For the dissolvable material to dissolve, a portion of the dissolvable material must be in contact with an electrolyte when the device is in use. Therefore, the insulating material cannot cover the entire surface of the dissolvable material.

The electrically insulating material may be a structural part of the device, for example a ceramic structure configured to have a function in the wellbore after dissolution of the dissolvable material. It may also be applied as a thin coating onto the dissolvable material, whereby its only function is to prevent electrical connection between the first and more noble material. The electrically insulating material may be any non-conducting material, for example a ceramic or a plastic material, depending on what is most suitable for the specific application of the device.

The more noble material may be a part of the device itself, for example if the device is configured to block fluid flow for a limited time and the restrict fluid flow after the dissolvable material is dissolved. The device may for example comprise a nozzle made of the more noble material which provides strength and resist long-term wear, a plug made of the dissolvable material for blocking fluid flow for a limited time, and an electrically insulating material between the two to prevent electrical connection, thereby increasing the time period in which the device functions as a plug. Alternatively, the more noble material may be a part of the surroundings, for example a metal tubing in the wellbore. In the example above, wherein the device is configured to initially block fluid flow and then restrict fluid flow after dissolution of the dissolvable material, the device may comprise a nozzle constructed in a strong, electrically insulating material, for example a ceramic material. Finally, the more noble material may be a part of a complementary tool connected to the device. The more noble material may typically be steel or tungsten carbide, as these materials are often used in wellbores.

The dissolvable material may for example comprise magnesium or a magnesium alloy, which has been shown to be able to dissolve within a time period which is suitable for some applications in a wellbore. However, magnesium is susceptible to galvanic corrosion, and it is furthermore positioned at the bottom section of the galvanic series, i.e. it is one of the least noble metals. Dissolution of a dissolvable material comprising magnesium therefore occurs very rapidly if the dissolvable material is in contact with another metal. However, use of magnesium in the dissolvable material assures that it is the dissolvable material which undergoes galvanic corrosion in case of electrical connection, and not any other part of the device or the surroundings.

The electrically insulating material may be arranged so that, when the device is in contact with a fluid, any distance between the dissolvable material and the more noble material measured through the fluid is longer than a predetermined value. The predetermined value may for example be selected to be large enough to avoid or significantly decrease the risk of an electrical connection being formed through the fluid by an electrically conducting component. During dissolution, a small portion of the dissolvable material may remain as debris close to the device. The debris may for example comprise zinc, aluminum, or a biproduct from the dissolution. If the distance between the dissolvable material and the more noble material of the device is short, particles from debris may form a bridge between the dissolvable material and the more noble material which may conduct electricity. This may cause galvanic corrosion and speed up the dissolution rate if the dissolvable material is susceptible to galvanic corrosion. Speeding up the dissolution rate is generally undesirable.

The electrically insulating material may be arranged so that a contact area between the dissolvable material and the fluid is selected to cause the dissolvable material to dissolve over a predetermined time period. Since the dissolution of the dissolvable material occurs when it is in contact with the fluid, the rate of dissolution will depend on the area of the dissolvable material which is in contact with the fluid. Therefore, for a specific fluid and dissolvable material, it will be possible to find a correlation between the contact area and time it takes for the dissolvable material to dissolve. This correlation may be exploited to select the contact area based on the time period over which it is desired that the dissolvable material dissolves.

The device may typically be configured to block the flow of the fluid for a limited time period. Alternatively, the device may be configured to limit fluid flow for a limited time period.

In a second aspect, the invention relates to a tubing comprising the device according to the first aspect of the invention. The device may for example be installed and configured to block the flow of the fluid for a limited time in the radial direction of the tubing. A tubing comprising the device in such a configuration may be particularly useful in the completion step when the tubing is run in the wellbore. The tubing will in this situation allow circulation of fluid through the bottom of the liner to displace the entire wellbore with the desired fluid, function as a mean for well control in case of unexpected pressure build-up, or simply function as a means for fluid circulation and aid installation of tubulars. Additionally, if the tubing comprising the devices can be run in the wellbore with a closed end, it can be used to pressurize the tubing, set production packers, and perform barrier test of the tubing.

In a third aspect, the invention relates to use of the device according to the first aspect to block fluid flow in a wellbore for a limited time period.

BRIEF DESCRIPTION OF THE DRAWINGS

In the following is described an example of a preferred embodiment illustrated in the accompanying drawings, wherein.

DETAILED DESCRIPTION OF THE DRAWINGS

Figure 1:
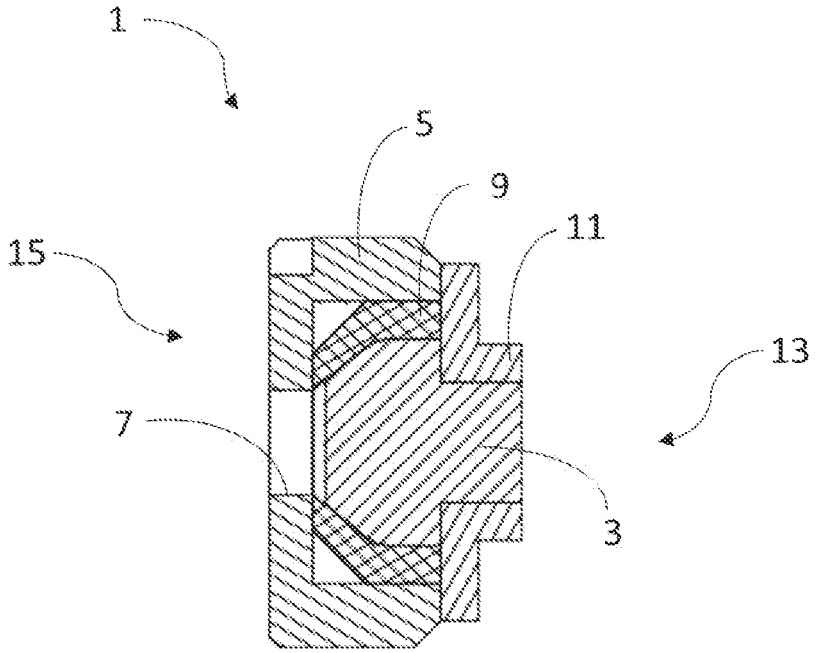
FIG. 1 shows a sectioned view of an embodiment of the device according to the invention.

In the drawings, the reference numeral 1 indicates a device according to the invention. Identical reference numerals indicate identical or similar features in the drawings. The drawings are presented in a simplified and schematic manner, and the features therein are not necessarily drawn to scale.

FIG. 1 shows a sectioned view of an embodiment of the device 1 according to the invention. The device 1 comprises a dissolvable material 3 in the form of a plug which blocks the flow of fluid until the dissolvable material 3 has dissolved. The device 1 also comprises a more noble material 5 in the form of a nozzle configured to restrict the flow of the fluid through an opening 7 after the dissolvable material 3 has dissolved. An electrically insulating material 9 covers a portion of the dissolvable material 3 to keep the dissolvable material 3 out of contact with the more noble material 5. The device 1 comprises a further electrically insulating material 11 to increase the distance between the dissolvable material 3 and the more noble material 5 measured through the fluid when the device 1 is in use in a wellbore. The device 1 has a first side 13 and a second side 15. When the device 1 is in use in the wellbore, the first side 13 will be in contact with the fluid which acts as an electrolyte. The dissolution of the dissolvable material 3 will therefore occur on the first side 13, and the distance between the dissolvable material 3 and the more noble material 5 is longer on the first side 13 than on the second side 15. The device 1 is configured to be positioned within an opening complementing the more noble material 5 so that there is no direct fluid communication between the first side 13 and the second side 15 when the device 1 is in use before the dissolvable material 3 has dissolved.

Figure 2:
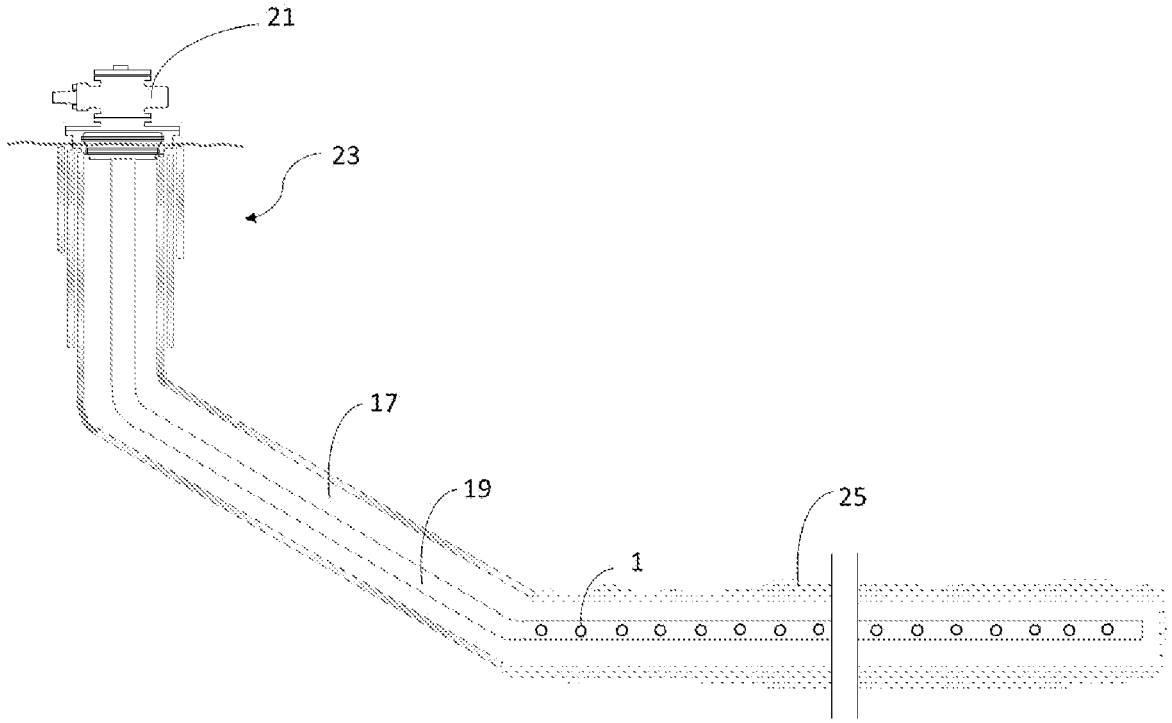
FIG. 2 shows a wellbore comprising a production tubing with the devices installed in the radial surface of the tubing.

FIG. 2 shows a wellbore 17 comprising a production tubing 19 installed within. The wellhead 21 and casing 23 is also indicated. The production tubing 19 comprises a plurality of the devices 1 in the radial surface of the production tubing 19. In this way fluid can initially be pumped through the tubing 19 along the longitudinal axis, but flow through the side of the tubing 19 via the devices 1 is prevented. This may for example be beneficial during the completion step as described above. After a period of a few days, the dissolvable material 3 has dissolved, and hydrocarbon flow from the reservoir 25 can be produced through the openings 7 of the devices 1.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The invention claimed is:

1. A device for temporarily blocking fluid flow through an opening in a radial surface of a tubing in a wellbore, the tubing having an inside and an outside, and the opening having a circumferential wall, the device having a first side and a second side, wherein, when the device is inserted in the opening, the first side faces the inside of the tubing and the second side faces the outside of the tubing, the device comprising:

-a plug made of a dissolvable material configured to dissolve over a limited time period, an electrically insulating material located between the plug and the circumferential wall of the opening in the radial surface of the tubing to prevent electrical connection between the dissolvable material of the plug and a material having a higher electrode potential than the dissolvable material, and -a further electrically insulating material located on the first side of the device and configured to increase a distance between the dissolvable material and the material having a higher electrode potential than the dissolvable material that is measured through the fluid on the inside of the tubing;

wherein the device is configured such that when the device is initially inserted in the opening of the tubing, the dissolvable material is exposed to a fluid on the inside of the tubing and on the outside of the tubing.

2. The device according to claim 1, wherein the material having a higher electrode potential than the dissolvable material is a part of the device.

3. The device according to claim 2, further comprising a nozzle made of the material having a higher electrode potential than the dissolvable material, wherein the nozzle houses the plug and the electrically insulating material.

4. The device according to claim 1, further comprising a nozzle made of the material having a higher electrode potential than the dissolvable material, wherein the nozzle houses the plug and the electrically insulating material.

5. The device according to claim 1, wherein the material having a higher electrode potential than the dissolvable material is a part of a complementary tool connected to the device.

6. The device according to claim 1, wherein the electrically insulating material comprises a ceramic material.

7. The device according to claim 1, wherein the dissolvable material comprises magnesium.

8. The device according to claim 1, wherein the further electrically insulating material comprises a ceramic material.

9. The device according to claim 8, wherein the further electrically insulating material is located on the first side of the device configured to increase a distance between the dissolvable material and the material having a higher electrode potential than the dissolvable material measured through the fluid on the inside of the tubing.

10. The device according to claim 1, wherein the distance is longer than a predetermined value.

11. The device according to claim 10, wherein the further electrically insulating material is configured such that a contact area between the dissolvable material and the fluid is selected to cause the dissolvable material to dissolve over a predetermined time period.

12. The device according to claim 1, wherein the further electrically insulating material is configured such that a contact area between the dissolvable material and the fluid is selected to cause the dissolvable material to dissolve over a predetermined time period.

13. A tubing comprising a device for temporarily blocking fluid flow through an opening in a radial surface of the tubing in a wellbore, the tubing having an inside and an outside, and the opening having a circumferential wall, the device having a first side and a second side, wherein, when the device is inserted in the opening, the first side faces the inside of the tubing and the second side faces the outside of the tubing, the device comprising:

-a plug made of a dissolvable material configured to dissolve over a limited time period, an electrically insulating material located between the plug and the circumferential wall of the opening in the radial surface of the tubing to prevent electrical connection between the dissolvable material of the plug and a material having a higher electrode potential than the dissolvable material, and a further electrically insulating material located on the first side of the device and configured to increase a distance between the dissolvable material and the material having a higher electrode potential than the dissolvable material that is measured through the fluid on the inside of the tubing;

wherein the device is configured such that when the device is initially inserted in the opening in the tubing, the dissolvable material is exposed to a fluid on the inside of the tubing and on the outside of the tubing, and wherein the device is inserted into the opening in the radial surface of the tubing, the opening complementing the device.

14. A method comprising using a device to block fluid flow through an opening in a radial surface of a tubing in a wellbore for a limited time period, wherein the device is configured to temporarily blocking the fluid flow through the opening, the tubing having an inside and an outside, and the opening having a circumferential wall, the device having a first side and a second side, wherein, when the device is inserted in the opening, the first side faces the inside of the tubing and the second side faces the outside of the tubing, the device comprising:

-a plug made of a dissolvable material configured to dissolve over a limited time period, an electrically insulating material located between the plug and the circumferential wall of the opening in the radial surface of the tubing to prevent electrical connection between the dissolvable material of the plug and a material having a higher electrode potential than the dissolvable material, and a further electrically insulating material located on the first side of the device and configured to increase a distance between the dissolvable material and the material having a higher electrode potential than the dissolvable material that is measured through the fluid on the inside of the tubing;

wherein the device is configured such that when the device is initially inserted in the opening in the tubing, the dissolvable material is exposed to a fluid on the inside of the tubing and on the outside of the tubing.

* * * * *